US007269881B2

(12) United States Patent
Farmer

(10) Patent No.: US 7,269,881 B2
(45) Date of Patent: Sep. 18, 2007

(54) VARIABLE ALIGNMENT HANDLE

(75) Inventor: Geoffrey A. Farmer, Ingatestone (GB)

(73) Assignee: Pitney Bowes Ltd., Harlow Essex (GB)

( * ) Notice: Subject to any disclaimer, the term of this patent is extended or adjusted under 35 U.S.C. 154(b) by 164 days.

(21) Appl. No.: 11/033,852

(22) Filed: Jan. 12, 2005

(65) Prior Publication Data

US 2006/0150370 A1 Jul. 13, 2006

(51) Int. Cl.
*G05G 1/06* (2006.01)

(52) U.S. Cl. ..... 16/441; 16/414

(58) Field of Classification Search ..... 16/441, 16/412, 414, 438, 445; 74/528, 543–548, 74/553; 403/329, 348, 362, 359.1, 359.2, 403/378, 97, 94; 81/177.8, 177.7, 60, 440; 292/348–349, 352, 355 X; 297/378.13, 463.1, 297/300.8, 300.5
See application file for complete search history.

(56) References Cited

U.S. PATENT DOCUMENTS 3,313,057 A * 4/1967 Leddy ..... 40/331
4,593,430 A * 6/1986 Spangler et al. ..... 16/441
4,761,886 A * 8/1988 Wilson et al. ..... 33/722
4,920,823 A * 5/1990 Mohr et al. ..... 74/553
4,965,942 A * 10/1990 Hoszowski ..... 33/730
5,337,450 A * 8/1994 Martin ..... 16/422
5,356,237 A * 10/1994 Sung ..... 403/374.3
5,388,307 A * 2/1995 Hyde ..... 16/441
5,509,174 A * 4/1996 Worrell ..... 16/441
5,810,504 A * 9/1998 Rabinovich ..... 403/371
6,216,565 B1 * 4/2001 McCann ..... 81/177.8

FOREIGN PATENT DOCUMENTS

EP 501130 A2 * 9/1992
EP 892182 A1 * 1/1999
JP 10326536 A * 12/1998

* cited by examiner

*Primary Examiner*—Chuck Y. Mah
(74) *Attorney, Agent, or Firm*—Brian A. Collins; Angelo N. Chaclas

(57) ABSTRACT

A handle for attachment to a rotational shaft, the handle comprising a lever handle, for attachment to the rotational shaft for aiding application of torque to the shaft, and an alignment boss, separate from the lever handle, for attaching the lever handle to the shaft and for aligning the lever handle at a predetermined orientation with respect to an alignment feature of the shaft.

11 Claims, 1 Drawing Sheet

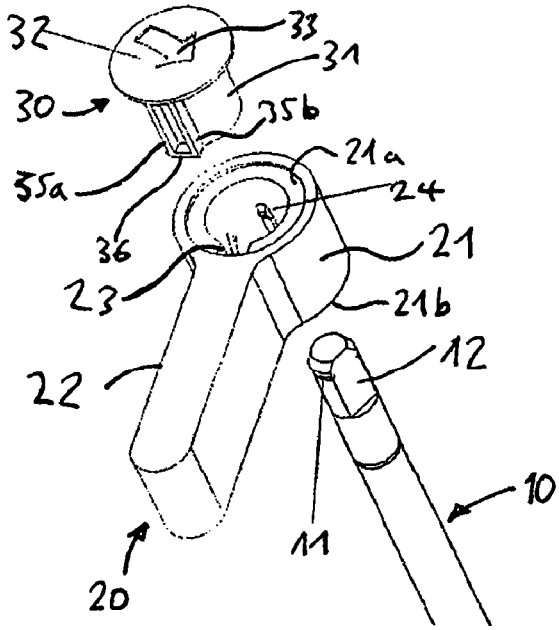
FIG. 1
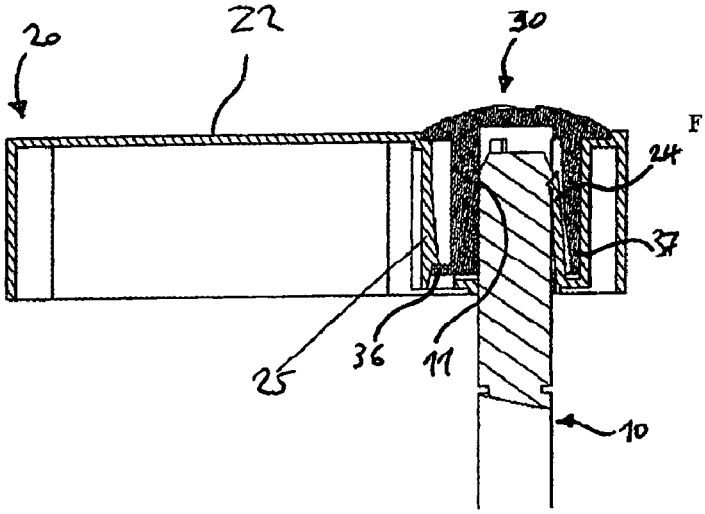
FIG. 2
FIG. 3
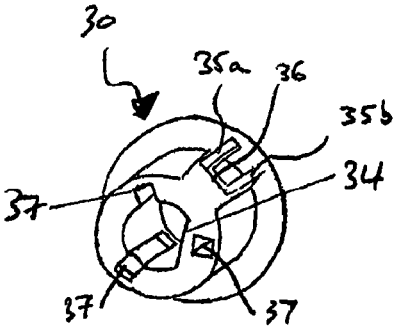
FIG. 4
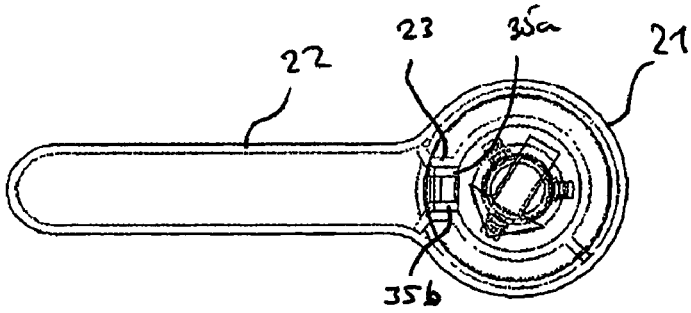

VARIABLE ALIGNMENT HANDLE

FIELD OF THE INVENTION

This invention relates to a handle system for attachment to and rotation of a rotational shaft.

BACKGROUND OF THE INVENTION

Many items of home and office equipment comprise enclosures which are normally shut, but which may be opened by manipulation of an access handle which is turned to release an associated mechanism. Such access handles are common, in particular in devices such as printers, photocopiers, fax machines and folder/inserter machines. Typically, the access handle is attached to a rotational shaft which forms part of a locking/release mechanism. Each handle has, essentially, two rotational orientations-open and closed. In the closed position, the handle is positioned to lock the mechanism in a closed or operational position which enables normal operation of the device in which it is located. In the open position, the associated mechanism becomes unlocked, allowing, for example, an access panel to be opened, a section of machinery to be removed, or a section of machinery to be moved from an operational position in which its performs normal function to an access position in which an operator may gain access to that machine section (as might be required in order to clear a jam or blockage or to replace print toner).

Typically, such access handles might consist simply of a cylindrical knob which may be turned to the appropriate orientation in order to either open or close the associated mechanism. More commonly, these access handles comprises a lever arm attached at one end to the rotational shaft to thereby allow a user to apply a larger torque to the shaft.

A typical arrangement might include an elongate lever arm attached to a cylindrical hub. The cylindrical hub has a hole therein which mates with a corresponding section on the shaft. In known handles, the hole has a D-shaped cross-section, and the corresponding shaft to which the handle is to be attached has a corresponding flattened section at one end to produce a D-shaped cross-section which mates with the D-shaped hole in the access handle.

Whilst this arrangement works adequately, it nevertheless has disadvantages.

In a device which has a plurality of access handles, it is likely that the handles will need to be located within the machine at various different orientations, both with respect to the machine itself and with respect to the flattened section of the rotational shaft. Thus, it is common that a separately-moulded handle element is required for each rotational shaft in the machine, each one of the handles having a hole with the D-shaped cross-section oriented at a different angle to the lever arm. This problem is particularly exacerbated by the manufacturing requirements of the rotational shaft. Theoretically, the flat portions of the rotational shaft could be oriented on each shaft in order that only a single design of handle would be needed. However, because of other components forming part of the rotational shaft, it is not always possible or economical to manufacture the shaft in this way, and the orientation of the flattened section of the shaft may be chosen purely for manufacturing reasons independent of alignment considerations with the handle.

A further consideration is that it is often desirable to label the hub of the handle with an appropriate symbol, such as an arrow or lettering. The alignment of such labelling is therefore dependent not only upon the orientation of the D-shaped part of the rotational shaft, but also on the orientation of the handle lever arm when attached to the rotational shaft.

SUMMARY OF THE INVENTION

A variable alignment handle is provided for attachment to a rotational shaft, the handle comprising:

a lever handle, for attachment to the rotational shaft for aiding application of torque to the shaft; and an alignment boss, separate from the lever handle, for attaching the lever handle to the shaft and for aligning the lever handle at a predetermined orientation with respect to an alignment feature of the shaft.

A method for attaching the handle is also disclosed to comprising the steps of:

i) sliding a lever handle component along the shaft from one end; sliding an alignment boss over the end of the shaft and obtaining rotational alignment of ii) the boss with a shaft alignment feature; and iii) sliding the boss along the shaft from the end of the shaft to force the boss into engagement with the lever handle to align the lever handle at a predetermined orientation with respect to an alignment feature of the shaft.

BRIEF DESCRIPTION OF THE DRAWINGS

For a better understanding of the invention and to show how the same may be carried into effect, reference will now be made, by way of example, to the accompanying drawings, in which:

FIG. 1 is a perspective view of an embodiment of the present invention in disassembled form;

FIG. 2 is a cross-sectional view of the embodiment of FIG. 1 showing the fully-assembled handle;

FIG. 3 is a perspective view showing the detail of one component of the embodiment of FIGS. 1 and 2; and FIG. 4 is a plan view of the component of the embodiment of FIGS. 1 to 3 showing the relative orientation of two of the components.

DETAILED DESCRIPTION OF THE INVENTION

Throughout the drawings, the same reference numerals are used to describe the same or like features. A single embodiment is shown throughout FIGS. 1 to 4. However, this embodiment should not be taken to be limiting and is used purely as an exemplary embodiment in order to improve understanding of the present inventive concept.

As seen in FIG. 1, the handle of the instant embodiment comprises two components: a lever handle 20 and an alignment boss 30. The two components are sized and dimensioned for attachment to a rotational shaft 10. In order to assemble the handle to the shaft, the lever handle 20 is first slid over one end of the shaft 10 and part way there along. The alignment boss 30 is then slid over the same end of the shaft 10 and simultaneously engages both the lever handle 20 and the shaft 10, thereby fixing the relative orientation between the shaft 10 and the lever handle 20 and preventing further axial or rotational movement of the lever handle 20 relative to the shaft 10.

Considering the components in more detail, with reference to FIGS. 1 to 4, the lever handle 20 comprises a tubular engagement portion 21 which has a substantially cylindrical outside surface from which a lever arm 22 extends in a radial direction. The tubular portion 21 is open at both ends and has a hole running along the length thereof. The tubular portion has two end faces 21*a* and 21*b*. The hole in the first end face 21*a* has a cross-section which is substantially key-hole shaped, formed of a circular portion and a comparatively small rectangular portion 23 extending therefrom in one direction. In the illustrated embodiment, rectangular portion 23 is aligned with lever arm 22. The circular portion of the key-hole shaped opening has a larger diameter than the shaft 10 to which the handle is to be attached. At the other face 21*b* of the lever handle, the hole is approximately equal in diameter to the shaft 10 due to a lip (seen in FIG. 2) extending from the inner face of the key-hole shaped opening in the tubular section 21. This lip abuts the shaft 10 when the handle is attached thereto. Extending axially into and along the key-hole shaped opening from the lip are a plurality of fingers 24 which engage with a snap ring groove 11 in the shaft 10. The fingers comprise an axial portion which has a barb at one end that locks into the snap ring groove 11.

The alignment boss 30 comprises a tubular section 31 which is essentially cylindrical in shape. The tubular section is open at one end and closed at the other end by a cap 32. The cap 32 may be embossed, printed or otherwise marked on an external surface thereof with a symbol, letter or other mark represented here by an arrow 33. As can be seen from FIG. 3, the tubular portion 31 has an inner surface 34 which is substantially D-shaped in cross-section. This hole corresponds to a portion 12 of the shaft 10 which has a D-shaped cross-section where a portion of the shaft has been flattened. When the alignment boss 30 is slid over the end of the shaft 10, the hole 34 must be aligned with the D-shaped end section to mate the boss to the shaft to prevent relative rotation between the shaft and alignment boss. The outer surface of the tubular section 31 is substantially cylindrical except for an engagement portion comprising axially extending ridges 35*a* and 35*b*. These ridges align with the rectangular notch 23 in lever handle 20 when the alignment boss 30 is inserted into the key-hole shaped opening in the lever handle. This prevents relative rotation between the alignment boss 30 and the lever handle 20. At the open end of the tubular section 31, the two ridges 35*a* and 35*b* are joined by a web 36. When the alignment boss is pushed into the key-hole shaped opening in the lever handle 20, the web 36 engages a snap fit element 25 in the lever handle which locks the alignment boss in place to prevent it being axially removed from the lever handle 20.

Extending axially along the D-shaped hole in tubular section 31 of the alignment boss 30 is a plurality of pockets 37 corresponding to the plurality of engagement fingers 24. Each pocket has an opening which is deeper at the open end of the tubular section 31 and becomes shallower towards the cap end of the tubular section, as best seen in FIG. 2. As the alignment boss is pushed into engagement with the lever handle, each of the engagement fingers 24 is received within one of the pockets 37. As the alignment boss is pushed into the lever handle, the inclined inner surfaces of the pockets 37 act as camming surfaces to force the engagement fingers 24 radially inwardly and press the engagement fingers against the shaft 10. This locks the barb portion of each finger into the snap ring groove 11, preventing the lever handle from moving axially relative to the shaft 10.

Once the handle is fully assembled, the fingers 24 and pockets 37 prevent the lever handle from moving axially relative to the shaft by engaging the snap ring groove 11, whilst the engagement between the snap fit element 25 and the web 36 prevents the alignment boss 30 from being retracted axially from the lever handle 20. Therefore the handle is now locked axially onto the shaft 10. The rotational orientation of the alignment boss is fixed relative to the shaft 10 by the mating alignment of D-shaped section 12 of the shaft and D-shaped hole 34 of the alignment boss. This prevents relative rotation between the shaft and alignment boss. The lever handle 20 has a fixed orientation relative to the alignment boss 30 due to engagement of ridges 35*a* and 35*b* with the rectangular groove 23 in the lever handle 22. This prevents relative rotation between the alignment boss and lever handle. Thus, the lever handle 22 has a fixed orientation relative to the shaft 10 due to mutual engagement with alignment boss 30.

The lever arm 22 allows sufficient torque to be readily applied to the lever handle in order to rotate the shaft 10. This force is transmitted to the shaft 10 from the lever handle 20 via ridges 35*a* and 35*b* in the alignment boss and subsequently via the engagement of the flat portion of the D-shaped cross-section portion of the shaft with D-shaped hole 34 in the alignment boss. The fingers 24, therefore, need not be configured to transmit any of the applied torque between the lever handle 20 and alignment boss 30, although this is possible.

In order to assemble the handle onto the shaft, the lever handle 20 is first slid onto the shaft so that the fingers 24 engage with the snap ring groove 11 of the shaft, preventing axial movement of the lever handle relative to the shaft. Next, the alignment boss 30 is slid over the end of the shaft and is then rotated in order to align the D-shaped hole 34 with D-shaped portion 12 of the shaft. Once these portions have been correctly aligned, the lever handle 20 is rotated relative to the shaft 10 and alignment boss 30 in order to align the rectangular portion 23 of the key-hole shaped opening in the lever handle with the ridges 35*a* and 35*b* of the alignment boss. This automatically aligns each of the engagement fingers 24 of the lever handle with the pockets 37 in the alignment boss 30. The alignment boss 30 is then pushed fully onto the shaft 10, which forces it into the key-hole shaped opening in the lever handle 20. This forces the engagement fingers 24 into permanent pressing engagement with the snap ring groove 11, and locks the alignment boss 30 into the lever handle 20 due to engagement of snap fit element 25 of the lever handle with web 36 of the alignment boss.

A feature of the present design is that it allows a number of alignment bosses to be produced which each have the D-shaped hole at a different orientation to the ridges 35*a* and 35*b*. Thus, any desired alignment may be achieved between rotational shaft 10 and lever handle 20 by appropriately selecting an alignment boss 30 which has the D-shaped hole and ridges 35*a* and 35*b* appropriately aligned. Further, this allows the symbol 33 on the cap 32 of alignment boss 30 to be appropriately oriented for each of the produced alignment bosses, such that the marking, when the handle is assembled, will have the correct orientation relative to the shaft 10 (and ultimately the device in which it is installed).

This arrangement is advantageous since it avoids the need to produce a different handle design for each angular orientation relative to the shaft or for each shaft to be adjusted at the handle end. In the situation where a unitary handle is produced which may be attached to a shaft at a number of different orientations, the possibility arises that the handle may be incorrectly attached to the shaft at an undesirable orientation. This possibility is removed according to the present handle system because each lever handle 20 has only a single orientation which is defined by the chosen alignment boss 30. In the second situation, where the shafts are simply machined so as to have the D-shaped portion 12 at the correct orientation, machining costs can be increased. This is due to the nature of various other components located along the shaft which may have complex and inter-related machining requirements.

The interaction between the engagement fingers 24 and the pockets 37 means that the lever handle is held extremely securely onto the shaft 10 in the axial direction by engagement with the snap ring groove 11.

Because each of the alignment bosses is produced separately for each of the shafts in a machine, the label 33 may be appropriately chosen. Appropriate labels might be numbers or lettering indicating the part of the machine where the handle is located when assembled. Alternatively, the label 33 might be an appropriate symbol, such as an arrow to indicate various orientations of the handle. A further possibility is to apply a trade mark to the cap 32 of the alignment boss 30, in order to improve brand recognition. The label may be applied to the alignment boss by a variety of means, such as printing, embossing, moulding etc.

In the described embodiment, three engagement fingers 24 are depicted within the lever handle 20, along with three corresponding pockets 37 in the alignment boss. However, the number of fingers is chosen as a matter of preference and in accordance with the chosen material from which the handle is to be manufactured. The inventors have found that preferable results are achieved when the number of engagement fingers is between 3 and 5.

Although the engagement between the lever handle 20 and alignment boss 30 has been described as engagement of the web 36 by the snap fit element 25, alternative known methods may be used, such as an interface fit or interlocking annular rings which may be snapped into place. Further, the exact shape of the components is not critical. In particular, a lever handle could be created having a plurality of lever arms 22 extending from the tubular portion 21.

Whilst the above-described embodiment uses a D-shaped cross-section to achieve a mating engagement between the alignment boss 30 and the rotational shaft 10, the invention is not limited to this shape, and any suitable mating engagement may be chosen. Similarly, the described embodiment utilises an alignment boss having a cap 32. This limits the application of the handle to attachment at the end of the shaft 10. However the attachment mechanism by which the handle becomes locked to the shaft could be applied to a handle located at any point along the shaft, providing that appropriate mating features are chosen for the shaft 10 and alignment boss 30. In this case, the cap 32 of alignment boss 30 is not used.

What is claimed is:

1. A handle for attachment to a rotational shaft, the handle comprising:

a lever handle operable to impart torque to the shaft; the lever handle including a notch having a retention element and a plurality of resilient engagement fingers; and a removable alignment boss, separate from the lever handle, for detachably affixing the lever handle to the shaft at a predetermined angular orientation with respect to an alignment surface of the shaft, the alignment boss including a plurality of cam sufaces, axially extending ridges, and a transverse web disposed between the axially extending ridges, the ridges engaging the notch to inhibit relative rotation between the lever handle and the alignment boss, and the transverse web engaging the retention element to maintain the relative axial position between the lever handle and the alignment boss;

the cam surfaces operable to urge the resilient engagement fingers into locking engagement with the rotational shaft to maintain the relative axial position between the alignment boss and the shaft.

2. The handle according to claim 1, wherein the engagement fingers each include a barb protruding inwardly toward the rotational axis of the shaft, and wherein the shaft includes a retention groove for accepting the barb of each engagement finger.

3. The handle according to claim 2, wherein the engagement fingers extend from one end of the lever handle in an axial direction.

4. The handle according to claim 2 wherein upon attachment of the lever handle to the shaft, the alignment boss is axially pressed into the tubular engagement portion to effect radial displacement of the engagement fingers of the lever handle with the retention groove of the shaft and, when fully engaged, the transverse web snaps into engagement with the retention element to retain the axial position of the alignment boss.

5. The handle system according to claim 2 wherein the alignment boss is marked on a face thereof with distinguishing markings, the markings being visible when the handle lever is attached to the rotational shaft.

6. A handle system comprising:

at least one rotational shaft having an alignment surface and a retention groove:

a lever handle operable to impart torque to the shaft; the lever handle including a notch having a retention element and a plurality of resilient engagement fingers; and at least one removable alignment boss, separate from the lever handle, for detachably affixing the lever handle to the shaft and for aligning the lever handle at a predetermined angular orientation with respect to an alignment surface of the shaft, the alignment boss including a plurality of cam surfaces, axially extending ridges, and a transverse web disposed between the axially extending ridges, the ridges engaging the notch to inhibit relative rotation between the lever handle and the alignment boss, and the transverse web engaging the retention element to maintain the relative axial position between the lever handle and the alignment boss, the cam surfaces operative to urge the resilient engagement fingers into locking engagement with the rotational shaft to maintain the relative axial position between the alignment boss and the shaft.

7. The handle according to claim 6, wherein the engagement fingers extend from one end of the lever handle in an axial direction and include a barb at a free end thereof engaging the retention groove.

8. The handle according to claim 6 wherein, upon attachment of the lever handle to the shaft, the alignment boss is axially pressed into the tubular engagement portion to effect radial displacement of the engagement fingers of the lever handle with the retention groove of the shaft and, when fully engaged, the transverse web snaps into engagement with the retention element to retain the axial position of the alignment boss.

9. The handle system according to claim 6, comprising a plurality of alignment bosses, each boss for attaching the same lever handle to the same shaft at different predetermined orientations to the shaft alignment surface.

10. The handle system according to claim 9 comprising a plurality of rotational shafts, and wherein each of the plurality of rotational shafts is associated with a specific one of the plurality of alignment bosses, the specific one of the alignment bosses aligning the lever handle with the alignment surface of the shaft at the correct predetermined orientation for that shaft.

11. The handle system according to claim 10 wherein each alignment boss is marked on a face thereof with distinguishing markings, the markings being visible when the handle lever is attached to the rotational shaft.

* * * * *